US006401282B1

(12) United States Patent
Shum

(10) Patent No.: US 6,401,282 B1
(45) Date of Patent: Jun. 11, 2002

(54) MODULAR MATTRESS SYSTEM

(76) Inventor: Hai Shum, 131 Maynard St., S. F., CA (US) 94112

( * ) Notice: Subject to any disclaimer, the term of this patent is extended or adjusted under 35 U.S.C. 154(b) by 0 days.

(21) Appl. No.: 09/855,106

(22) Filed: May 14, 2001

(51) Int. Cl.[7] ..... A47C 27/00; A47C 27/10

(52) U.S. Cl. ..... 5/722; 5/723; 5/727; 5/729; 5/701; 5/710

(58) Field of Search ..... 5/722, 723, 727, 5/729, 739, 690, 691, 697, 701, 935, 710

(56) References Cited

U.S. PATENT DOCUMENTS

| | | | | | |
|---|---|---|---|---|---|
| 1,927,109 | A | * | 9/1933 | Abrams | 5/722 |
| 2,000,873 | A | | 5/1935 | Arens | 5/706 |
| 2,112,702 | A | | 3/1938 | Loible | 5/600 |
| 2,532,425 | A | | 12/1950 | Schenker | 5/401 |
| 2,814,053 | A | * | 11/1957 | Sevcik | 5/727 X |
| 2,879,523 | A | * | 3/1959 | Klassen et al. | 5/723 |
| 3,656,190 | A | | 4/1972 | Regan | 5/613 |
| 4,005,236 | A | | 1/1977 | Graebe | 428/72 |
| 4,175,549 | A | * | 11/1979 | Hamer | 5/727 X |
| 4,477,935 | A | * | 10/1984 | Griffin | 5/241 |
| 4,525,886 | A | * | 7/1985 | Savenije | 5/727 X |
| 4,662,012 | A | | 5/1987 | Torbet | 5/713 |
| 4,750,224 | A | | 6/1988 | Stracke | 5/655.3 |
| 4,799,276 | A | | 1/1989 | Kadish | 5/613 |
| 4,852,195 | A | | 8/1989 | Schulman | 5/713 |
| 4,982,466 | A | | 1/1991 | Higgins | 5/713 |
| 5,038,429 | A | * | 8/1991 | Elmalek et al. | 5/236.1 |
| 5,070,560 | A | * | 12/1991 | Wilkinson | 5/722 X |
| 5,105,488 | A | | 4/1992 | Hutchinson | 5/710 |
| 5,127,114 | A | * | 7/1992 | Horburger | 5/239 |
| 5,152,019 | A | | 10/1992 | Hirata | 5/655.4 |
| 5,323,499 | A | | 6/1994 | Chan | 5/693 |
| 5,412,821 | A | * | 5/1995 | Wilkinson | 5/709 |
| 5,416,936 | A | * | 5/1995 | Chan | 5/701 X |
| 5,487,196 | A | * | 1/1996 | Wilkinson et al. | 5/715 |
| 5,524,307 | A | * | 6/1996 | Griffin | 5/710 |
| 5,692,258 | A | * | 12/1997 | Griffin | 5/710 |
| 5,784,731 | A | * | 7/1998 | Weber | 5/238 |
| 5,873,137 | A | | 2/1999 | Chen | 5/713 |
| 5,953,779 | A | * | 9/1999 | Schwartz | 5/722 |
| 6,085,373 | A | * | 7/2000 | Montana | 5/727 |
| 6,286,160 | B1 | * | 9/2001 | Langegger et al. | 5/239 X |
| 6,298,505 | B1 | * | 10/2001 | Brivio | 5/236.1 |
| 6,305,038 | B1 | * | 10/2001 | Elkhuizen et al. | 5/241 |

FOREIGN PATENT DOCUMENTS

| | | | | | |
|---|---|---|---|---|---|
| FR | 1161152 | A | * | 8/1958 | 5/723 |
| FR | 2692477 | A1 | * | 12/1993 | 5/729 |

* cited by examiner

*Primary Examiner*—Robert G. Santos

(57) ABSTRACT

A mattress system, sofa, cushioned seat, and the like, having top surface made from rigid material which is divided into plurality of polygonal columns or spherical shapes and configured into a geometrical pattern in various size and shape which has the transversal width and the longitudinal length adding or reducing according to the user's preference. The top surface elements are correspondingly supported by plurality of resilient elements, which are pneumatic in general, adjustable to provide the preferable comfort, desirous top surface contour and prescriptive pressure at particular spots. The top surface elements and resilient elements are individually replaceable and exchangeable. The mattress, sofa, cushioned seat and the like can be retrofit or modified three dimensionally.

3 Claims, 7 Drawing Sheets

MODULAR MATTRESS SYSTEM

BACKGROUND OF THE INVENTION

The present invention relates to mattress, sofa, cushioned seat and the like, more particularly to the improvement of body supporting device adjustable three dimensionally. Before the invention of the modern spring mattress and sofa, human had slept on rigid hard surface such as wood planks. The comfort and warmness were generally provided by using layers of natural fibers. This original way of sleeping had contributed to the evolution of human body figure, the bone structure, the spine contour and the human sleeping habit over the past thousands of years.

Several industrial revolutions have changed our living condition, daily habit, mentality, and medication. The brain of human being is able to adapt changes in a pace much faster than the physical body thereof.

While our brain is enjoying or working on modern technological achievements, our body is actually suffering. While our brain is evolving with the development of modern technology, our physical body condition is deteriorating.

As already mentioned that it had taken a million years to evolve a human being physical structure, and it had taken a few thousands years to build up our sleeping habit; one hundred year history of spring mattress has been merely the beginning for our body to accept this modern way of sleeping. It may take the next few hundred years, if not a few thousand years, to evolve our bone structure to fully adapt this modern way of sleeping, which has brought us the separation of our brain and our body, has brought us imbalance, has brought us chronic back pain.

Certainly, the spring mattress is comfortable, but we are compromising our health for it. A better way of sleeping, a better body supporting device is necessary for us. New, better mattress have been introduced and produced. But most of them are merely the improvement of the spring or foam types. This unhealthy way of sleeping continues. Currently, there is a back to nature, back to original, back to classics movement; also, the environment protection has become ever urgent. Alternative treatment is getting popular. The invention of a healthy body supporting device is inevitable. An innovative way of sleeping is bound to happen. The present invention of this modular mattress serves this purpose.

SUMMARY OF THE INVENTION

One of the many objectives of this invention is the combined benefit of health and comfort. It does not sacrifice one for the other.

The upper section of the invention embodiment is an assembly of rigid elements, which offers the hardness, acupressure and ventilation. The lower section of the invention embodiment is an assembly of resilient elements correspondingly bears the upper section rigid elements, offers variable top surface outline to track human body figure contour, providing the uniform support to every parts of the body. The firmness of the mattress can be adjusted, varies from spot to spot, from one section to another section.

As denoted in its title, the invention attains its main objective by providing the convenience of being easily customizing and retrofiting by employing differential elements, which are integrated together into the preferable size and shape of user's choice. Horizontally, in transverse and longitude, adding or reducing the discrete elements will modify the size and the shape thereof. Vertically, changing the pneumatic pressure of the resilient elements will modify the firmness of the mattress either sectionally or entirely. It is dynamic in three dimensions. The advantage of this device also exhibits on the easiness of relocation. It can be totally dismantled, fit into a box and quickly reassembled in a new destination.

This invention has another objective by presenting an aesthetic geometric pattern to its surroundings. As revealed in the drawings, the top surface rigid elements are hexagonal columns integrated into a honeycomb mosaic.

The top surface rigid elements, in general, are made from wood, expressing its natural grain. It can further be colored, offers additional beauty.

This invention has another important stated objective by providing an easy access to every component of the embodiment. Beside that, every component is durable and long lasting, it can be quickly exchanged, swapped or replaced in case one component is found defective. Every component of the present invention embodiment is washable. It can be washed individually or washed as a whole assembly.

This invention offers an advantageous objective of being extremely cost effective. With its durability, it is also easily repairable. These distinguishing qualities of this invention embodiment makes itself a virtually perpetual furniture. It should last one's life time or generations. The initial expense is from mediocre to average. It is broadly affordable. Considering that, a third of human life time is spent on bed. Dividing the initial expense from the total bedding time, the cost per hour of bedding time is a virtual zero.

This invention offers a further objective of using reproducible natural ingredients, mostly soft wood and rubber, the consumption of metal and plastic is reduced to a minimum. It is environmentally friendly. This invention presents an extra particular objective that it is an all seasonal furniture. The wooden, well ventilated top surface gives a relievable comfort in the hot summer nights. Natural fiber such as cotton, palm fiber or goose down padding is utilized to increase the top surface smoothness and softness or to increase the warmness during the cold weather condition.

DETAILED DESCRIPTION OF THE INVENTION

A modular mattress, sofa system presents an innovative embodiment comprising numerous components divided into four groups.

Figures 1, 1A:
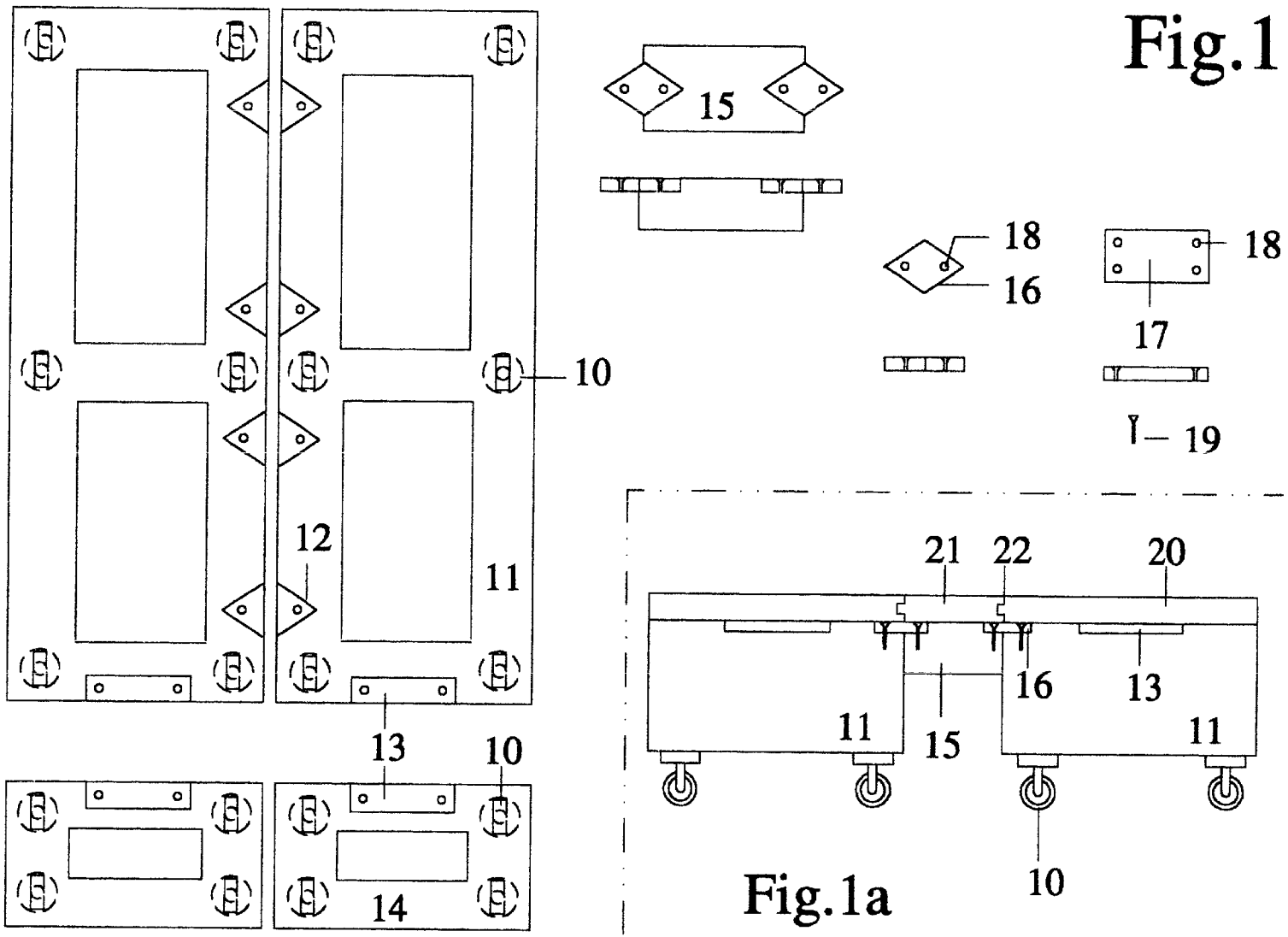
FIG. 1: a top view of the "full-size" mattress platform, the longitudinal extension and the hardware.
FIG. 1*a*: a vertical end view of a "queen-size" mattress platform.

The first group is the platform, which serves the purpose of raising and retaining the mattress from the floor. As shown in FIG. 1, it consists two sections 11, identical except the four pre-carved diamond shape receptacles 12 that are symmetrical to the counterparts. The two sections 11, jointed together by four diamond shape adapters 16 on the receptacles 12, become a standard "full-size" frame. Although this invention attains its title by being able to integrate discrete components to any size and shape of the user's choice having an intention to be a "modular system"; standard sizes gives an advantage of utilizing the existing standard sizes bedding sheets in the early stage, before the consumer fully accepting this "modular system" concept. For this reason, the frame section 11 is made to the longitudinal length as a standard one, instead of being divided in the middle to become two separated sections. There is another advantage of this undivided one fill length section, considering the center of weight of the common user is in the lumbar area, which applied to the middle of the mattress and the supporting frame. A divided frame reduces its own strength. To compensate this arrangement, an extension section 14 is added for extra length requirement. Joiner 17 is used to link section 11 and section 14 together at receptacle 13. Pre-drilled holes 18 are on joiner 17 and adapter 16 for screw 19. For the "queen-size" and "king-size", bridges 15 are used to expand the transversal width thereof Wheels 10 are used, giving better mobility and better appeal. There are six wheels under each section 11, and four wheels under each extension section 14.

FIG. 1*a* shows an assembled "queen-size"; bridge section 15 are installed between two main sections 11. Without installation of extension section 14, the receptacles 13 exposed. Adapters 16 are in the receptacles 12 with screws 19 in places. Wheels 10 are visible. Board 20 is in same width and length as the main frame section 11. For a "queen-size", an expander board 21 is inserted between two boards 20. Board 20 and board 21 are same in their lengthwise that cover the entire longitude of the main section 11 giving un-interrupted continuity of support to the main mattress embodiment. A tongue and groove method 22 is utilized for better joint of the boards. Bridge 15 for the "king-size" are also available, which are bigger than the "queen-size" bridge. For the "twin-size", one frame section 11 is narrower than the three footer transversal width of the "twin-size" board, leaving six inch of board overhanging on both side of the frame section 11. This is the only cantilevered situation. For this, standard hardware fastener is used to secure them together.

This completed the assembly of the Group one preferred embodiment. This modular mattress system can also be assembled and used on a leveled floor, without using a platform described above, same way as those conventional spring mattress.

Figure 2:
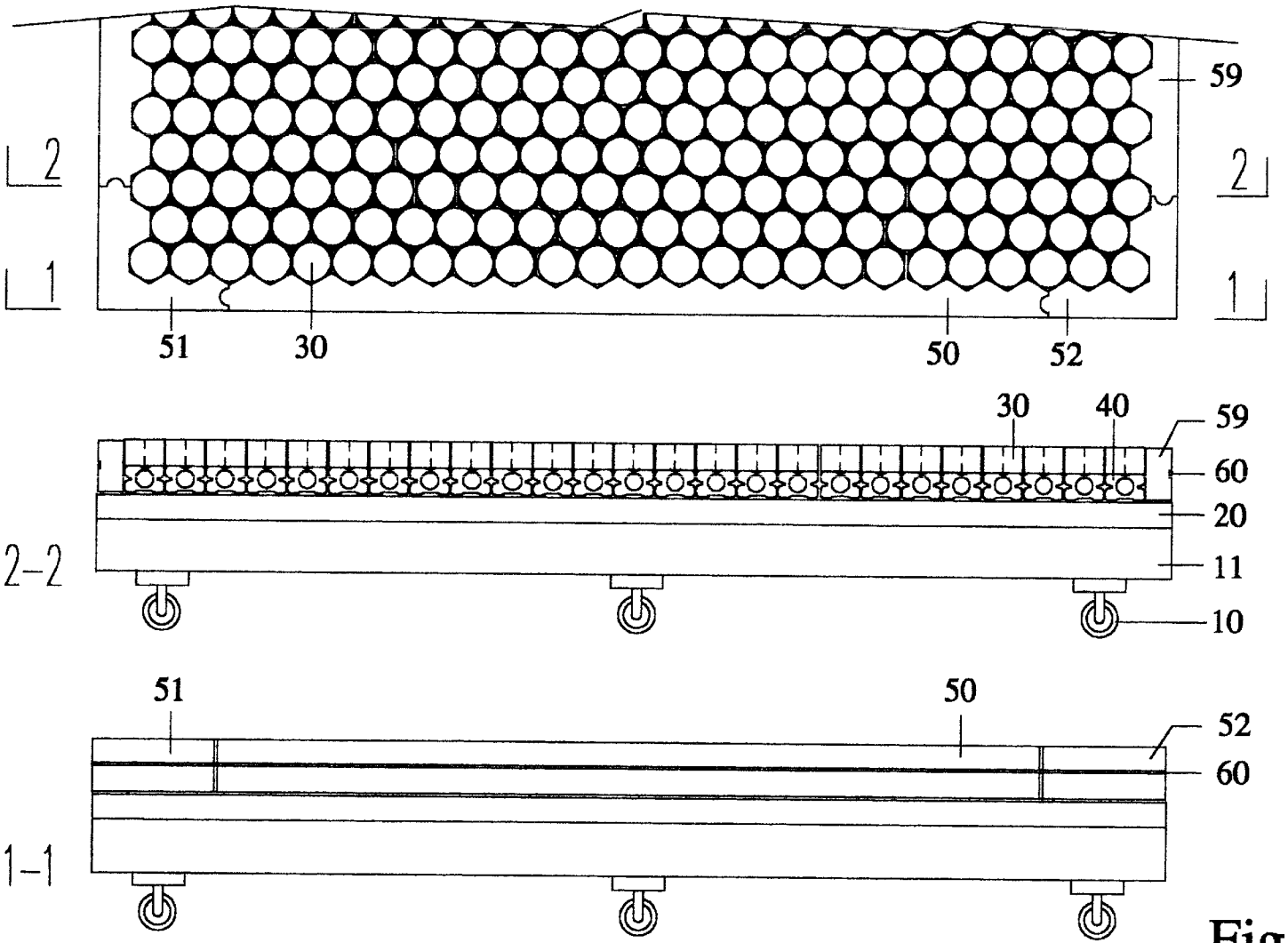
FIG. 2: a partial top view of the mattress surface, a vertical side view and a vertical cross-sectional view, completion of assembly.
Figure 4:
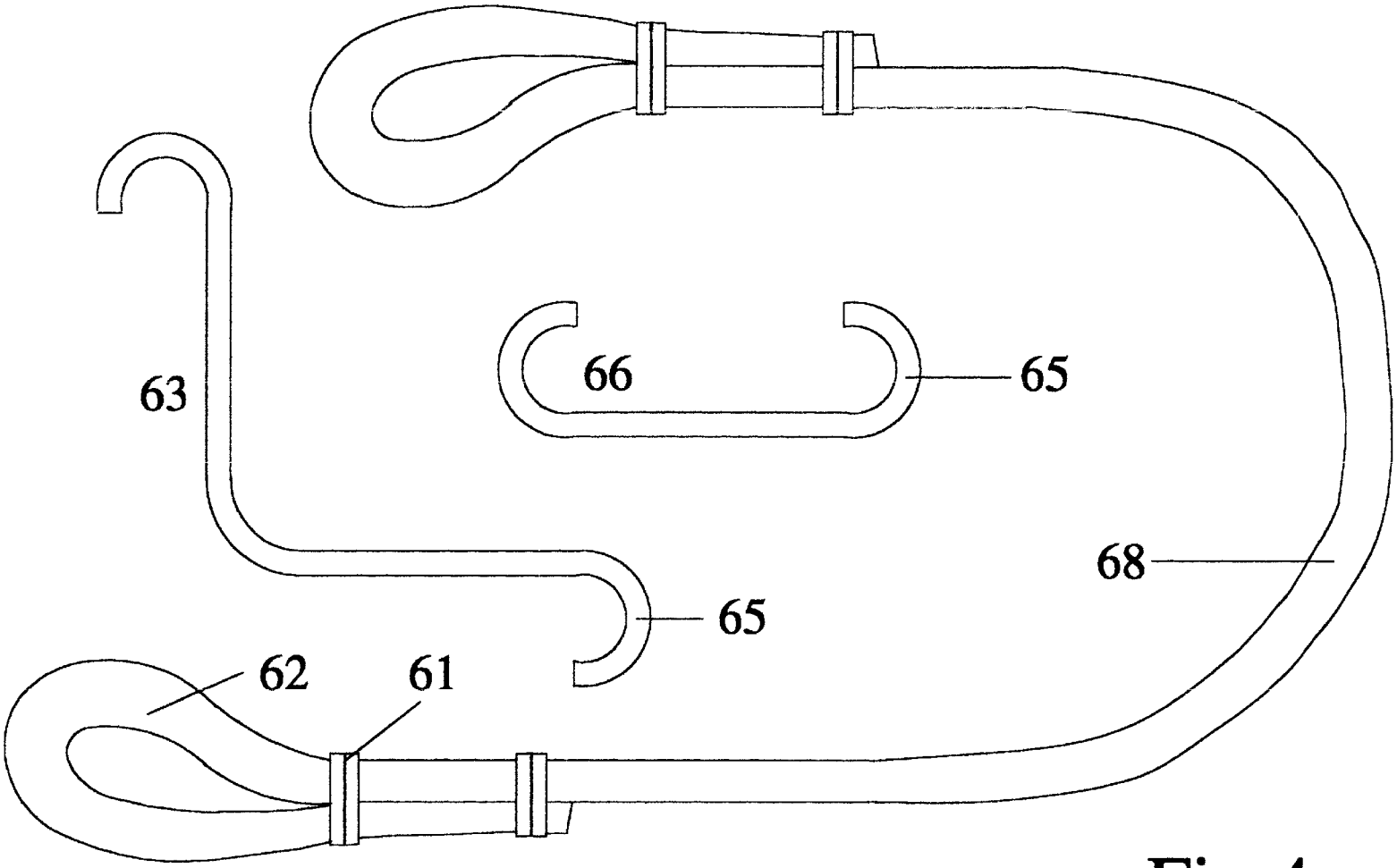
FIG. 4: a belt and two couplers.

FIG. 2 further displays the "platform" in longitudinal side view without the extension 14. From the bottom up, wheels 10, main frame section 11 and board 20 underlay the Group two, Group three and Group four preferred embodiments. View 1—1 illustrates the entire complete assembled longitudinal side view of the preferred embodiment of this invention. Group four components, edge units 50, 51, 52 and 59 (shown in view 2—2) circumferentially wrap Group two and Group three components. Channel 60, in the middle of edge units along the entire length thereof, provides a steady place for the belts and couplers (discuss in FIG. 4).

View 2—2 illustrates the cross-sectional complete assembled preferred embodiment of this invention. At the head end and the toe end, the transversal edge unit 59 are displayed, channel 60 is visible at the middle thereof. Between the edge units 59, there are Group two components—the rigid elements 30 and Group three components—the resilient elements 40, which are the main novelty of this invention. The surface of the mattress would track the human body contour to every fine point, if the surface was divided infinitesimally into minima elements. As already mentioned, for the interest of general public, combine the comfort, the health, the economic and the practical use, four rigid elements per foot is the optimal division. For this honeycomb pattern top surface configuration, twenty-four/twenty-five rigid elements per six footer standard length mattress is the favorable arrangement.

Again, in FIG. 2, the partial horizontal top view reveals the favorable honeycomb mosaic pattern that offers not only the handsome appearance but also the structural stability and durability. The over all advantage of honeycomb construction is broadly recognized, it may not be necessary to discuss further in the scope of this invention. But it is not exclusive of other geometric patterns. Triangle, rectangle, arrangement may be used as well. In the future, consumer may choose a cylinder, an oval or a sphere instead of a polygonal column shape for the surface rigid elements. To assemble this modular mattress is not difficult.

Figure 3:
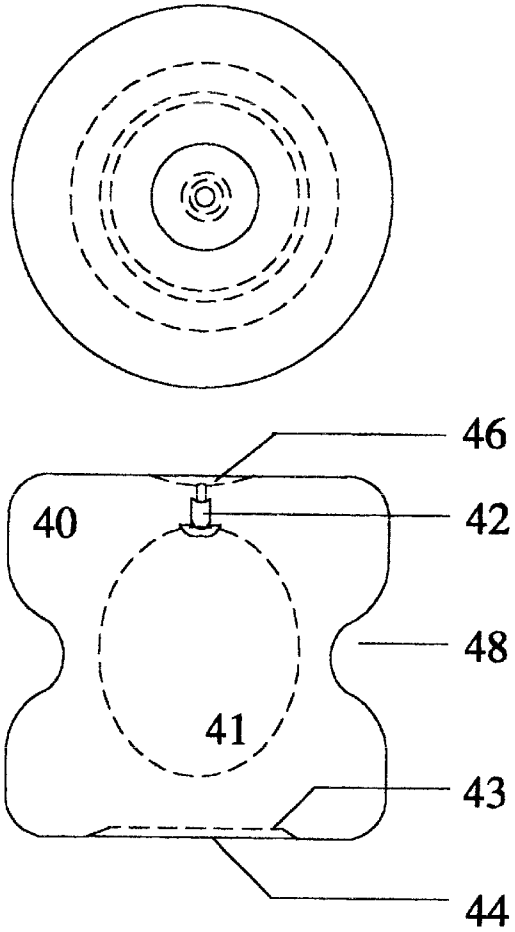
FIG. 3: a vertical view and a top view of the rigid element; a vertical view and a top view of the resilient element.
Figure 3:
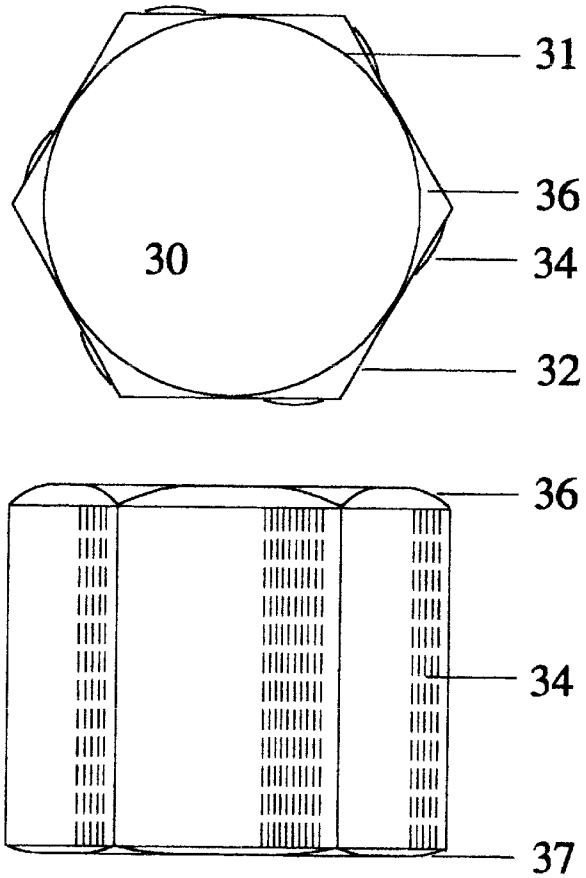

While FIG. 2 displays the entire preferred embodiment of present invention at the completion of integration, details of the novel rigid element and resilient element are given on FIG. 3.

For a honeycomb surface configuration, the rigid element 30 is a regular hexagonal column that has the top and bottom sides in regular hexagonal shape; the six vertical sides 32 are identical regular rectangles. A thin resin coating stripe 34 is applied to near the right margin of the vertical side 32 across the entire height of the rigid element 30. This resin stripe 34 is applied to all six sides of all rigid element 30, identical in their length, width, thickness and location. When two adjacent rigid elements 30 encounter as in the mattress assembly, these resin stripe 34 will keep a micro gap between two opposite sides 32, providing ventilation for the mattress and lubrication against friction of two opposite sides 32, allowing individual differential vertical movement of the rigid element 30 from each other.

Horizontal movement of the rigid element 30 is limited by its six adjacent peers, also limited by the combination binding of all peripheral elements and the belts and couplers, the tightening means. For the comfort of the mattress user, the six protrusive corners of top and bottom sides are filed away, giving six slopes. The six top side corners having unified larger degree of slope 36 offer smoother mattress surface than six bottom corners having unified smaller degree of slope 37. The user has two choices of surface smoothness.

When the bottom side of rigid element 30 with slope 37 is chosen, the user will have a slightly acupressure feeling while lying on the mattress, due to its six more protrusive corners. The top view of the rigid element 30 reveals a inscribed circle 31 appeared when the six corners were filed away; a same diameter circle should appear at the bottem as well. As mentioned above, approximately four rigid elements per each longitude foot length is the optimal solution to figure out the numbers of rigid elements required. For a standard "full-size", which is six feet by four feet; approximately four hundred rigid elements are needed. These rigid elements are generally made from reproducible soft wood, such as fir or pine. Diversification is encouraged to offer variable options, inlaying cedar wood element to give natural scent; other raw material may be used to reduce wood consumption; non-flamable material may be used to give safety for smoking people; magnetic elements can be arranged to give a field treatment; as a few examples. Various shape of elements may be used for various needs.

FIG. 3 further presents the Group three component, the resilient element 40 that is made from rubber or similar resilient material. Its diameter is slightly less than the diameter of the inscribed circle 31 of the rigid element 30. A pneumatic air chamber 41 is in the center thereof. Via an one way air valve 42 on the top, the air chamber 41 is pumped to offer a pressurized center that determines the firmness of the mattress. Each rigid element 30 is bore by a resilient element 40. By tuning the air pressure to various degree, the mattress offers various firmness from region to region, from point to point; or by harmonizing the air pressure to same degree to unit the firmness. The vertical movement allowance of the upper array rigid elements are determined by the firmness. A circumference of waist 48 is added to the middle of the resilient element 40 to increase the dynamic range. The base 44 in conjunction with concave indentation 43 gives the resilient element 40 a better grasp on the board 20, 21. A notch indentation 46 on the top center gives an entrance to the air valve 42 sing in the center lowest point thereof. During the deepest compression of the resilient element 40, the bottom of the rigid element 30 should not have contact with the air valve 42. The initial cost could be lower, if the resilient element 40 was made of solid rubber without a cavity, but had no choice of variable firmness. The air valve 42 is a low lost valve reducing the periodical re-pump of air. An air pump with air gauge indicater and predetermined output level setting may be included in this modular mattress system kit giving the user convenience to regulate and monitor the pneumatic pressure.

The Group four components are illustrated in details from FIG. 4 through FIG. 7. Swing with FIG. 4, the belt 68 is made from semi-elastic material wrapped with fiber in a lewd covering from one third to one half of the length of the mattress, two permanent closed loops 62 are on the two ends thereof, fixed by two metal clamps 61.The loops 62 are the receptacles for the hooks 65 of the couplers 63 and 66 made from rigid material. Coupler 63 has a ninety degree bent fitting into the channel 60 of the corner edge elements 51 or 52. Coupler 66 is linear straight fitting into the channel 60 of linear edge element 50, 59, 53 and 54. Hooks 65 and loops 62 are produced to accompany each other with minimum wear and tear. Couplers and belts are connected alternately to firm a secure loop tying all discrete components into an integrated modular mattress. The semi-elastic material of the belt 68 gives a certain degrees of flexibility to the enclosed modular mattress making it to be more comfortable. The channel 60 can be replaced by a tunnel inside the edge elements, invisible from outside of the assembled modular mattress system. Or to make the tightenning means as a part of the edge elements, but that will cost more.

Figure 5:
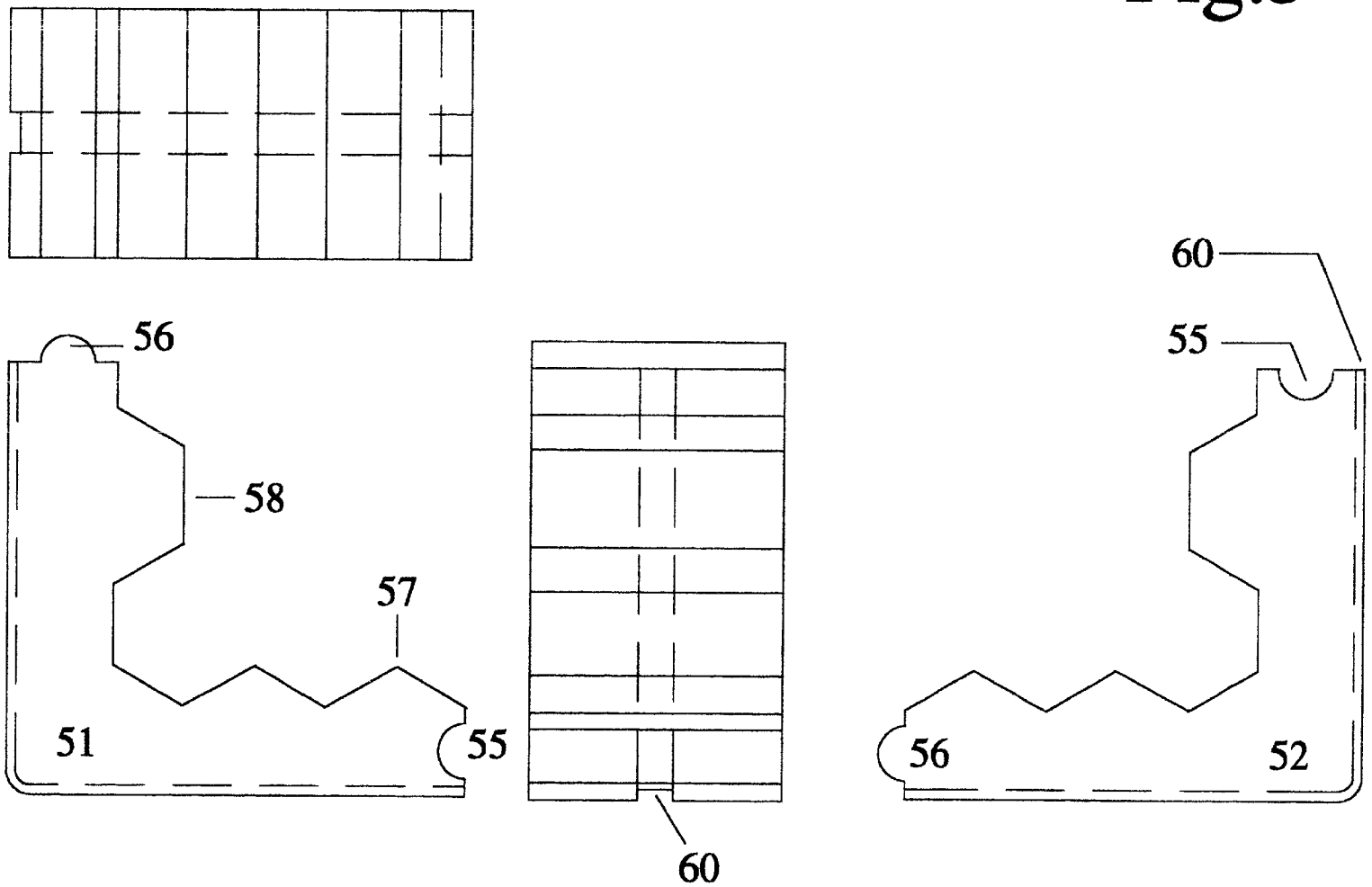
FIG. 5: two corner edge elements.

FIG. 5 introduce the corner edge element with two side views; and an opposite corner edge element 52, for which the two side views are identical to the edge element 51's turning one hundred eighty degrees. The channel 60 is carved along the middle of all the peripheral edge elements and around the corners thereof. The corner of the channel 60 of the corner edge elements 51, 52 are all smoothly rounded avoiding sharp projections. The sawtooth 57 encounters the rigid elements 30 on the longitudinal sides and the trapezoid 58 encounters the rigid elements 30 on the traversal sides. Semi-circle columns 56 plug into semi-circle columns receptacle 55 form "tongue and groove" joints, enforcing binding of the peripheral loop. For the "tongue and groove" column joints, using the semi-circle or trapezoid shape, having a gradual changing in cross-sectional area reducing the broken tendency thereof, are better than other cross-sectional shapes. The differences between corner edge element 51 and 52 are the opposite arrangement of the sawtooth 57, trapezoid 58, plug 56 and receptacle 55; for the opposite corners of the mattress. Again, for the "tongue and groove" joints, the plugs 56 and receptacles 55 of all peripheral edge elements are toward one direction for forming a closed loop.

Figure 6:
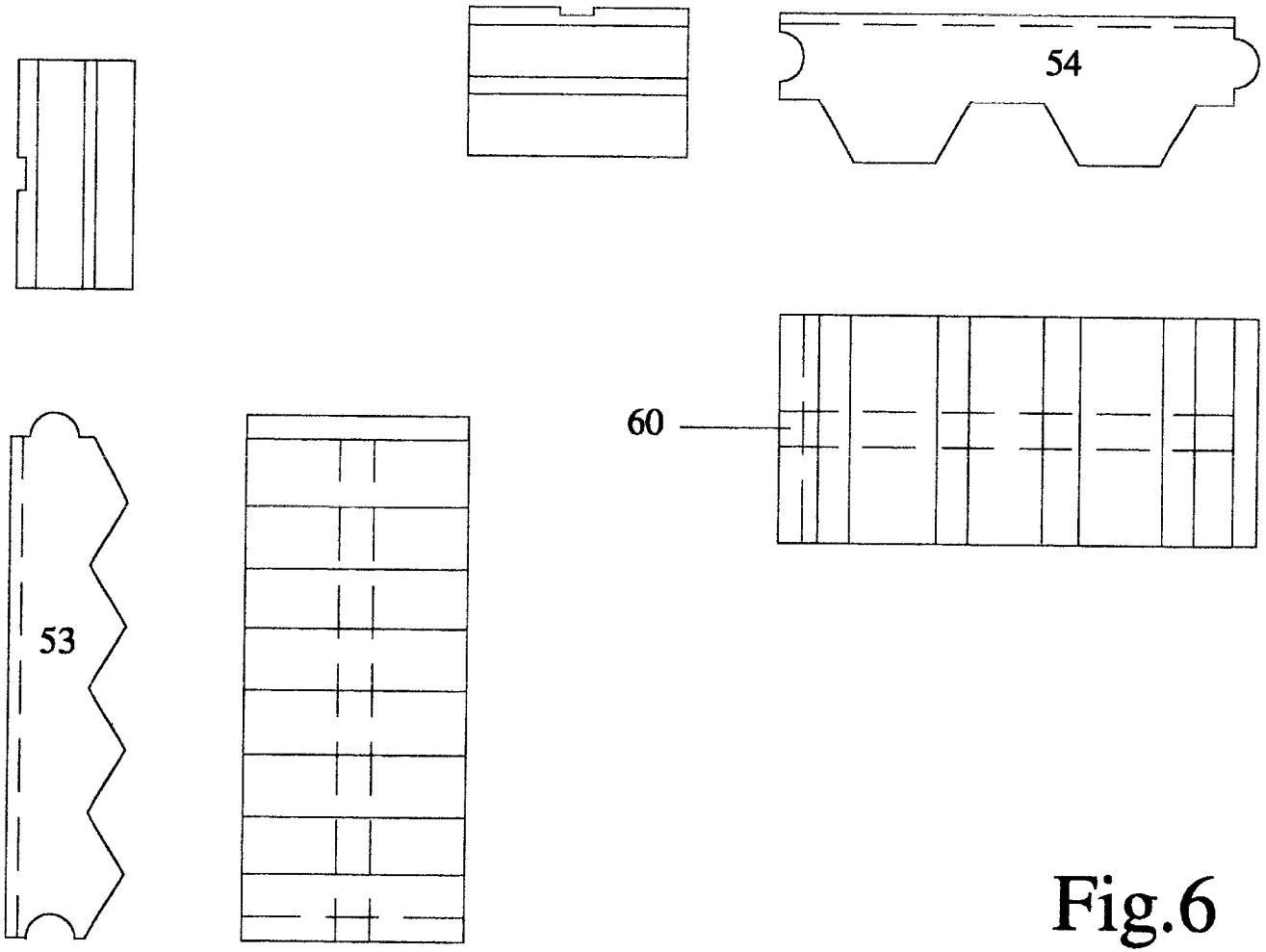
FIG. 6: a transversal extension edge element and a longitudinal extension edge element.

Two edge elements are exhibited in FIG. 6; one is the longitudinal extension linear edge element 53 and the other one is the transversal extension linear edge element 54, with side views for both edge elements. The plug and receptacle columns 55, 56 are toward the same direction as described above. The channel 60 is visible as marked. The edge element 53 has four sawteeth to mesh with five rigid elements 30, this is for one foot length of longitude extension. The edge element 54 has two trapezoid to mesh with three rigid elements 30, this is for three quarter foot length of transverse extension.

Figure 7:
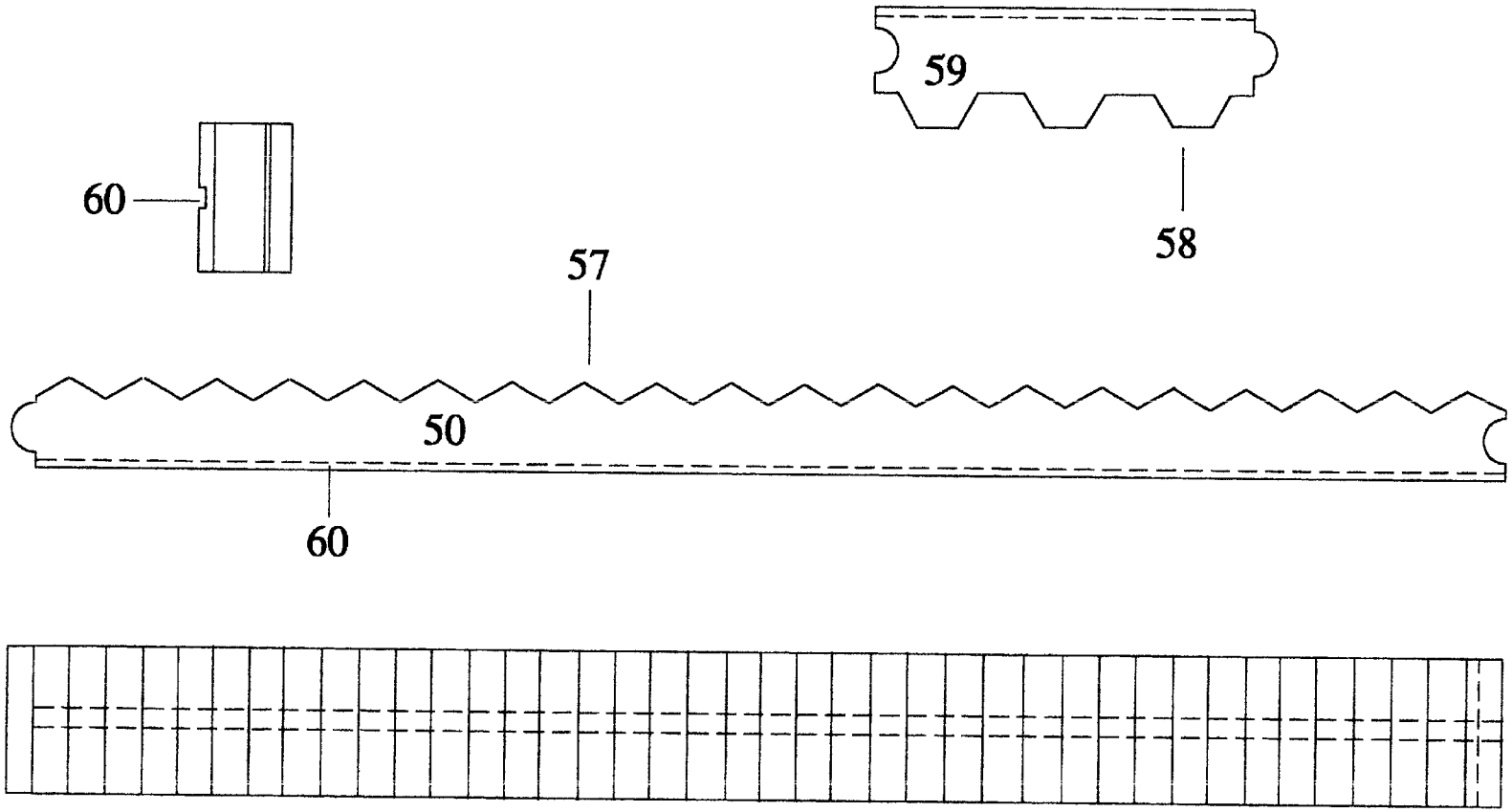
FIG. 7: a transversal edge element and a longitudinal edge element.

FIG. 7 reveals the standard longitudinal linear edge element 50 with two side views and the standard transversal linear edge element 59. These two elements are the longer version of edge elements 53 and 54 discussed in FIG 6. Noticeably, the plugs and the receptacles are toward same direction as all other version of edge elements. All the peripheral edge element are made from semi-resilient material.

A good assembly process of this innovative modular mattress is linking all necessary peripheral edge elements on the platform or on the floor first, fill the interior with resilient elements and rigid elements, tie the entire assembly with belts and couplers thereafter to complete the task.

I claim:

1. A modular mattress system being integrated from a plurality of groups of differentiated and discrete elements, three dimensionally reorganizeable, comprises: a plurality of upper array elements, a plurality of lower array elements, a plurality of edge elements and tightening means; said plurality of upper array elements being underpinned by said plurality of lower array elements individually and correspondingly; said plurality of upper array elements and plurality of lower array elements being encircled by said plurality of edge elements; and said tightening means comprising a plurality of belts and a plurality of couplers being connected to secure the encircling of said plurality of edge elements, thereby tying said plurality of upper array elements, said plurality of lower array elements and said plurality of edge elements into an integrated modular mattress.

2. The mattress system of claim 1, wherein said upper array elements, said lower array elements, said edge elements and the components of said tightening means being individually and manually replaceable; said plurality of upper array elements being solid and made from rigid material; said plurality of lower array elements being made from resilient material and being adjustable in firmness thereof, said plurality of edge elements being made from resilient material, and each of said plurality of edge elements having two opposed ends, an inner wall, and an outer wall.

3. The mattress system of claim 2, wherein said plurality of upper array elements, said plurality of lower array elements, said plurality of edge elements and said tightening means being made from washable and environmentally friendly materials; each of said plurality of upper array elements being in geometrical shape defined by a plurality of vertical walls and having at least one vertical coating stripe on each vertical wall thereof, said plurality of upper array elements being assembled into a geometrical pattern with a plurality of desirable protruding top surfaces; each of said plurality of lower array elements having a chamber in desirable size with a regulatable pneumatic pressure therein being fixed with an air intake valve, wherein each of said plurality of lower array elements further including an indentation on a plurality of surfaces thereof connecting to said plurality of upper array elements; each of said plurality of edge elements including a plug on formed on one of said two opposed ends, a receptacle formed on the other of said two opposed ends, and said inner wall being in geometrical shape meshing with said plurality of upper array elements, said plurality of edge elements being connected by said plugs and said receptacles thereof, thereby forming a closed loop, wherein said geometrical shape of said inner walls of said plurality of edge elements engage with said plurality of upper array elements to form the top surface of the modular mattress system into a geometrical pattern assembly, each of said plurality of edge elements having at least one channel horizontally formed in said outer wall thereof, said at least one channel horizontally extending continuously across the entire length of said outer walls when said plurality of edge elements being connected; and said tightening means situating within said at least one channel of said plurality of edge elements enforcing the integration of said mattress system.

* * * * *